US006591460B1

(12) United States Patent
Hoshino

(10) Patent No.: US 6,591,460 B1
(45) Date of Patent: Jul. 15, 2003

(54) BINDING CLIP

(75) Inventor: Takamichi Hoshino, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/614,703

(22) Filed: Jul. 12, 2000

(30) Foreign Application Priority Data

Jul. 13, 1999 (JP) ..... 11-199563

(51) Int. Cl.[7] ..... B65D 63/00; B65D 33/16

(52) U.S. Cl. ..... 24/30.5 S; 24/30.5 R; 24/30.5 T

(58) Field of Search ..... 24/30.5 P, 30.5 R, 24/30.5 S, 30.5 T, 545, 546, 570, 571, 908, DIG. 28; 53/138.2, 138.3, 138.4, 138.7, 138.9, 139.1, 583

(56) References Cited

U.S. PATENT DOCUMENTS

| | | | | | |
|---|---|---|---|---|---|
| 3,234,616 | A | * | 2/1966 | Wantland | 24/30.5 P |
| 3,535,746 | A | * | 10/1970 | Thomas, Jr. | 24/546 X |
| 3,882,573 | A | * | 5/1975 | Thomas, Jr. | 24/30.5 T |
| 3,910,811 | A | | 10/1975 | Paxton et al. | 156/521 |
| 3,983,681 | A | | 10/1976 | Britt et al. | 53/76 |
| 4,174,554 | A | * | 11/1979 | Flantua | 24/30.5 P |
| 4,357,186 | A | | 11/1982 | Calvert | 156/73.1 |
| 4,446,677 | A | | 5/1984 | Kokido | 53/577 |
| 4,497,091 | A | * | 2/1985 | Elliot | 24/545 X |
| 4,896,366 | A | | 1/1990 | Oxman | 383/71 |
| 5,269,120 | A | | 12/1993 | Holmes | 53/411 |
| 5,286,110 | A | * | 2/1994 | Benson et al. | 24/30.5 P X |
| 5,425,826 | A | | 6/1995 | Sayyadi et al. | 156/73.1 |
| 5,485,711 | A | * | 1/1996 | Suzuki et al. | 53/138.4 |
| 5,495,645 | A | * | 3/1996 | Suzuki et al. | 24/30.5 S |
| 5,564,255 | A | | 10/1996 | Giacomelli | 53/371.2 |
| 5,782,067 | A | | 7/1998 | Fuss et al. | 53/576 |
| 5,832,568 | A | * | 11/1998 | Higuchi | 24/30.5 R |
| 6,098,370 | A | * | 8/2000 | Kobayashi et al. | 53/138.3 |
| 6,112,499 | A | | 9/2000 | Lyskawa et al. | 53/138.7 |

FOREIGN PATENT DOCUMENTS

| | | | |
|---|---|---|---|
| JP | 2684937 | 8/1997 | |
| JP | 10-59334 | 3/1998 | |
| JP | 10-114308 | 5/1998 | 53/138.3 |
| JP | 0 936 147 A1 | 8/1999 | 53/138.3 |

* cited by examiner

*Primary Examiner*—Robert J. Sandy
*Assistant Examiner*—Ruth C. Rodriguez
(74) *Attorney, Agent, or Firm*—Morgan, Lewis & Bockius LLP

(57) ABSTRACT

A binding clip formed from a flat plate material. The binding clip comprises an opening at one end, a receiving portion, a pair of leg portions, and a pair of engaging projections. The receiving portion is for receiving an object to be bound in the depths of the opening. The leg portions defines the opening and are adapted to be crossed with each other thereby to bind the object to be bound. The engaging projections is bulgingly formed at portions continuing from the opening to the receiving portion. The engaging projections are adapted to overlap each other and project into the receiving portion when the leg portions are crossed.

12 Claims, 3 Drawing Sheets

BINDING CLIP

BACKGROUND OF THE INVENTION

1. Field of the Invention

The present invention relates to a binding clip for binding and closing a mouth of a packing container such as a bag, a net, or the like.

2. Description of the Related Art

As the binding clip of this type, there has been conventionally known a binding clip 1 which is disclosed in Japanese Patent No. 2684937 proposed by the Applicant. This binding clip which is formed from a flat and thin plate made of resin as shown in FIG. 4, has an opening 2 extending from one end toward the center of the binding clip and a receiving portion 3 for receiving an object to be bound such as a bag, a net or the like in a central part of the binding clip in the depths of the opening 2. A pair of leg portions 4, 5 are formed on both sides of the opening, and hooklike engaging portions 6, 7 are formed at distal ends of the leg portions respectively.

In order to bind the object 9 to be bound with this binding clip, the object 9 is received in the receiving portion 3. Then, the receiving portion 3 for receiving the object is reduced in diameter by crossing both the leg portions 4, 5 with each other to put the binding clip into a conical shape with the receiving portion 3 as an apex, thereby to exert a holding force on the object 9 to be bound in a direction of compressing the object. In this state, the engaging portions 6, 7 which are formed at the distal ends of the leg portions are engaged with each other to compress the object 9 to be bound as its diameter is reduced, thus completing the binding operation as shown in FIG. 6.

However, in case where an elastic material such as a plastic bag, a net or the like is to be bound with the above described binding clip, after the object 9 has been bound, a restitutive force is exerted in an outward direction of the bound portion as shown in FIG. 5. The force is converged on the crossed parts 8 of the leg portions 4, 5 in a direction where the crossed parts are expanded. Accordingly, the bag, net or the like moves toward the crossed parts, that is, comes out from the receiving portion 3 in a direction of A. Therefore, it has been a problem that the holding force will be lowered. Moreover, it has been another problem that commercial value will be degraded due to a bad appearance of the product because the object 9 to be bound has come out.

SUMMARY OF THE INVENTION

This invention has been proposed in view of such circumstances, and it is an object of the invention to provide a binding clip which can reliably hold and bind an object to be bound even in case where an elastic material such as a bag, a net or the like is to be bound.

According to the first aspect of the invention, a binding clip is formed from a flat plate material and comprises an opening at its one end, and a receiving portion for receiving an object to be bound in the depths of the opening, a pair of leg portions defining the opening being adapted to be crossed with each other thereby to bind the object to be bound, wherein a pair of engaging projections are bulgingly formed at portions continuing from the opening to the receiving portion for receiving the object to be bound, the engaging projections being adapted to overlap each other and project into the receiving portion for receiving the object to be bound when the leg portions are crossed, and the engaging projections being adapted to divide an expanding force of the object which has been bound in two directions when the engaging projections are overlapped.

According to the second aspect of the invention, a binding clip is formed from a flat plate material and comprises an opening at its one end, and a receiving portion for receiving an object to be bound in the depths of the opening, a pair of leg portions defining the opening being adapted to be crossed with each other thereby to bind the object to be bound, wherein a pair of engaging projections are bulgingly formed at portions continuing from the opening to the receiving portion for receiving the object to be bound, the engaging projections being adapted to overlap each other and project into the receiving portion for receiving the object to be bound so as to bite the object when the leg portions are crossed.

According to the third aspect of the invention, in the above-mentioned binding clip, the receiving portion for receiving the object to be bound is in a substantially triangular shape making a deepest end of the opening as an apex.

As described, the binding clip according to the invention is so constructed that a pair of engaging projections are formed at portions continuing from the opening to the receiving portion for receiving the object to be bound, the engaging projections being adapted to overlap each other and project into the receiving portion when the leg portions are crossed. Therefore, when the bag, net or the like is bound, a force of the object coming out toward the crossed parts of the leg portions will be divided in the two directions by means of the engaging projections, thus preventing the object to be bound from coming out toward the crossed parts of the leg portions.

Further, because a force of the plastic bag, net or the like which tends to expand will be held by the receiving portion and the engaging projections, the engaging projections are pressed against the plastic bag, net or the like which tends to expand, and distal ends of the engaging projections hold the plastic bag, net or the like in a biting attitude, whereby a strong binding force can be obtained.

Still further, because the receiving portion for receiving the object to be bound is in a substantially triangular shape making a deepest end of the opening as an apex, tapered portions consisting of the two edges having the deepest end as the apex act to press the plastic bag, net or the like, which tries to expand, toward the engaging projections, whereby a strong binding force can be obtained.

DETAILED DESCRIPTION OF THE PREFERRED EMBODIMENTS

Figure 1:
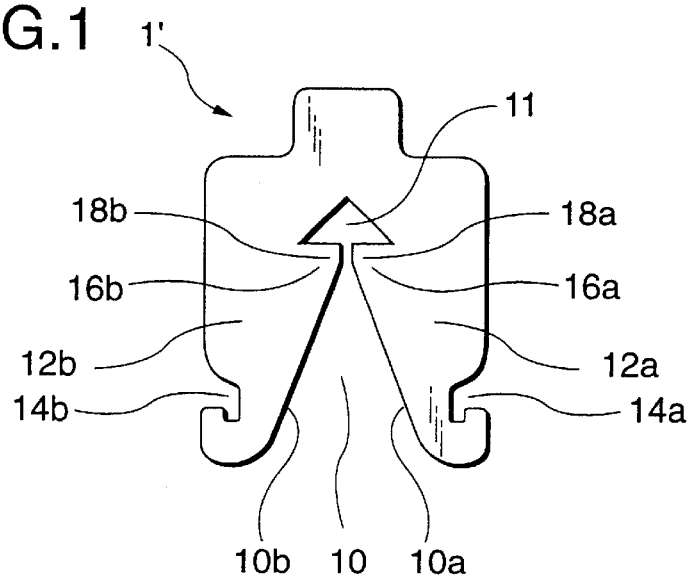
FIG. 1 is a plan view of a binding clip according to the invention.

Now, an embodiment of the invention will be described. As shown in FIG. 1, the binding clip according to the invention is formed from a flat and thin plate made of resin, and includes an opening 10 tapered from one end of the binding clip toward its center in a V-shape, and a receiving portion 11 for receiving the object to be bound in a substantially triangular shape which is provided in a central part of the binding clip in the depths of the opening 10 communicating therewith and adapted to receive a bag, a net or the like.

The receiving portion 11 is defined by receiving edges 20*a*, 20*b* which extend at an angle of substantially 90 degrees from an apex 23 in the deepest end. A pair of holding edges 19*a*, 19*b* are formed continuing from the receiving edges 20*a*, 20*b*, in a direction of right angle with respect to a longitudinal direction:of the binding clip. Both the receiving edges and the holding edges are formed in a crooked shape in cooperation with their respective mating edges.

A pair of leg portions 12*a*, 12*b* are formed on both sides of the opening 10, and hooklike engaging portions 14*a*, 14*b* are formed at distal ends of both the leg portions.

The opening 10 has opening edges 10*a*, 10*b*, and a pair of engaging projections 18*a*, 18*b* are formed at connecting portions 16*a*, 16*b* between the opening edges 10*a*, 10*b* and holding edges 19*a*, 19*b* respectively.

Now, operation of the binding clip of the above described structure will be explained.

First, the object 9 to be bound is inserted from the opening 10 of the binding clip 1' toward the receiving portion 11. Since the opening 10 is provided with the opening edges 10*a*, 10*b* tapered toward the center, the object 9 to be bound can be smoothly inserted. As the object 9 to be bound is inserted further, it will be received in the receiving portion 11 after the engaging projections 18*a*, 18*b* are elastically deformed to pass it through.

Figure 2:
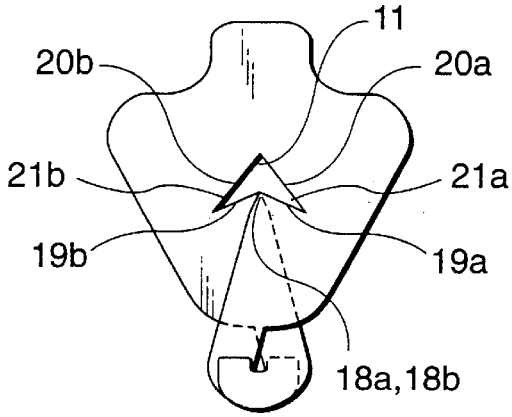
FIG. 2 is a plan view showing a state where leg portions of the binding clip according to the invention are crossed with each other.
Figure 3:
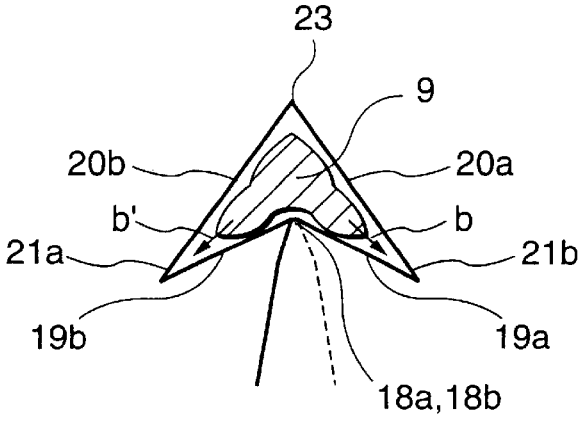
FIG. 3 is an enlarged view of a receiving portion for receiving an object to be bound in FIG. 2.
Figure 4:
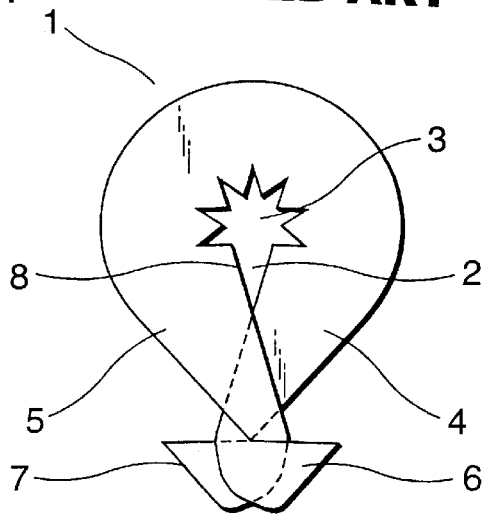
FIG.4 RELATED ART
FIG. 4 is a plan view showing a state where leg portions of a conventional binding clip are crossed with each other.
Figure 5:
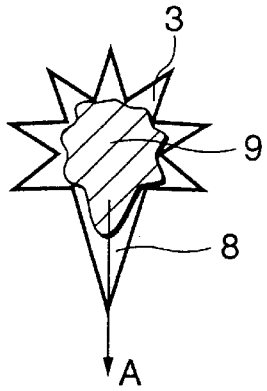
FIG.5 RELATED ART
FIG. 5 is an enlarged view of a receiving portion for receiving an object to be bound in the conventional binding clip.
Figure 6:
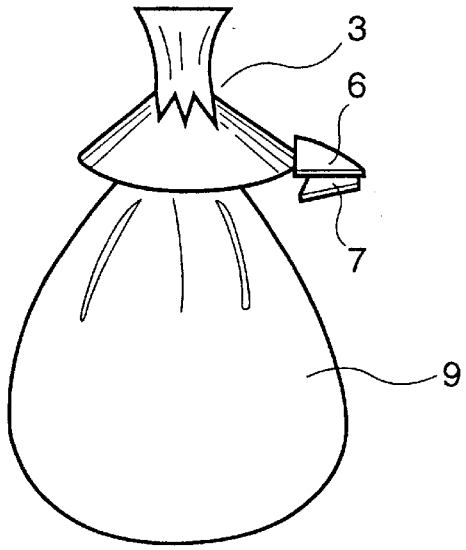
FIG.6 RELATED ART
FIG. 6 is a side view showing a state where the object to be bound has been bound by the binding clip.

After the object 9 to be bound has been received in the receiving portion 11, the holding edges 19*a*, 19*b* act as retaining members to hold the object 9 to be bound in the receiving portion 11. In this state, both the leg portions 12*a*, 12*b* are crossed with each other as shown in FIG. 2. Then, similar to the conventional binding clip as shown in FIG. 6, the binding clip is deformed into a conical shape which is enlarged downward with the receiving portion 11, corresponding to the receiving portion 3 in FIG. 6, as an apex so as to bind the object 9. As means for maintaining this state, the engaging portions 14*a*, 14*b*, corresponding to the engaging portions 6, 7 in FIG. 6, may be hooked with each other as shown in FIGS. 2 and 4, or mechanical means, for example, bonding of the crossed parts of both the leg portions by heat welding or so, caulking them with a press or the like, or stapling means such as a stapler or the like can be employed.

A shape of the receiving portion 11 when the leg portions 12*a*, 12*b* are crossed with each other will be in a state where the engaging projections 18*a*, 18*b* are overlapped on each other and projected into the receiving portion 11 in a crooked shape, making the overlapped parts of the engaging projections as an apex as shown in FIG. 2, and an acute angle will be formed between the receiving edges 20*a* and 20*b* with the apex 23 as a starting point, thus reducing an area of the receiving portion 11.

In this state, the object 9 will be clamped by the receiving edges 20*a*, 20*b* and guided by the receiving edges 20*a*, 20*b* to be pushed out toward the opening 10. However, due to the presence of the holding edges 19*a*, 19*b* whose apex is formed by the engaging projections 18*a*, 18*b*, the object 9 will receive a force divided in two directions of b and b', so as to be pushed out in the two directions into relief portions 21*a*, 21*b* while bulging, and then, bound. As the result, energy of the compressed object 9 will be divided in two as described above, and at the same time, will not expand the binding clip, because the object 9 is pressed by the holding edges 19*a*, 19*b*.

Moreover, because the engaging projections 18*a*, 18*b* will bite the compressed object 9, the binding force will be further enhanced.

Figure 7:
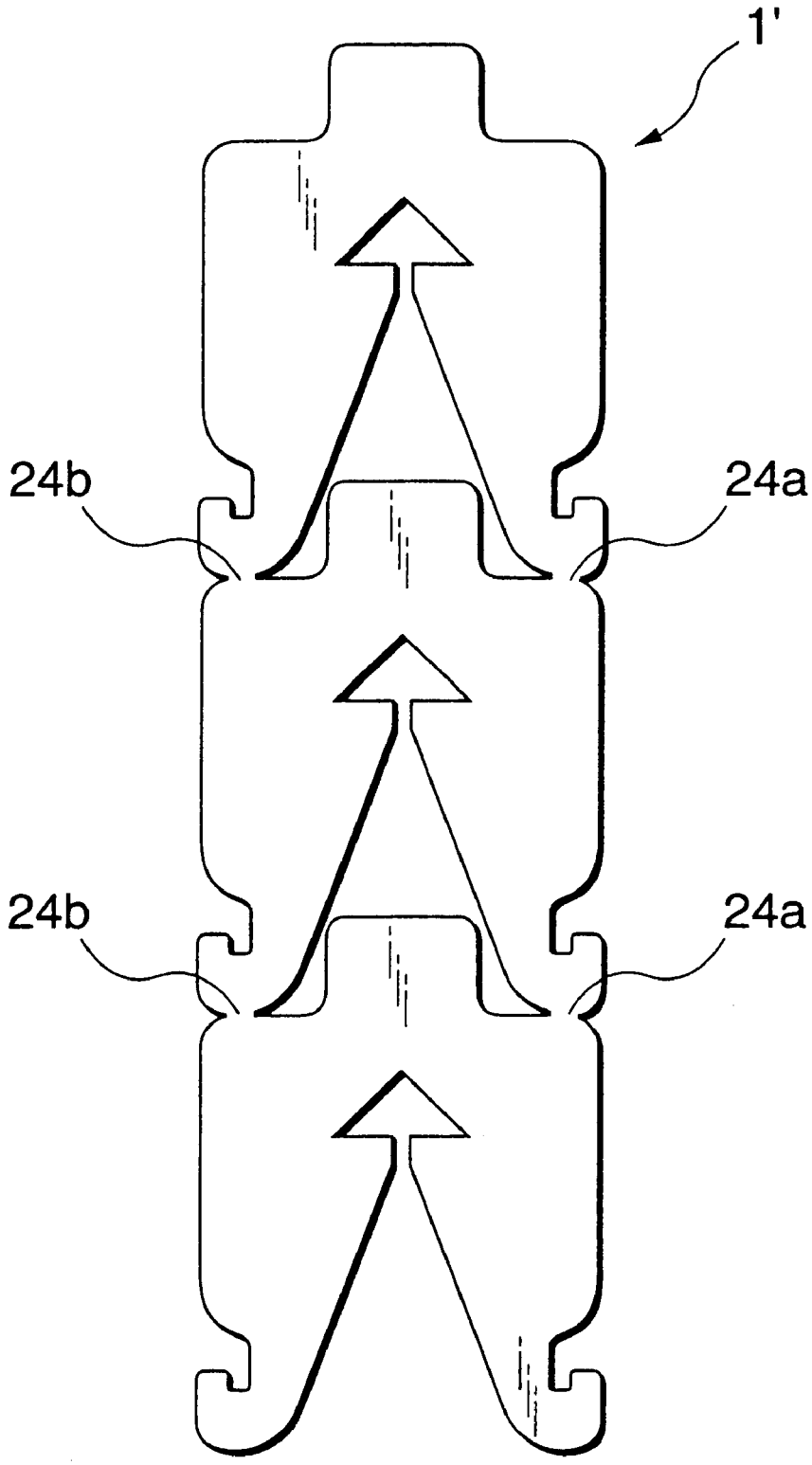
FIG. 7 is a plan view showing the binding clips in a connected state.

The binding clip 1' according to the invention has been described in detail referring to the embodiment in which it is used in a form of a single binding clip. However, a number of the binding clips connected with one another can be used by connecting the distal portions of both the leg portions of a binding clip with both shoulder portions formed at upper ends of both the leg portions of another binding clip at connecting parts 24*a*, 24*b* as shown in FIG. 7.

A number of the binding clips thus connected with one another can be wound into a roll shape to form an assembly consisting, of 500 to 2000 clips, and the assembly of the clips can be loaded in a binding machine, which is not shown, to conduct a binding operation, whereby a rapid binding operation can be continuously conducted.

As described hereinabove, the binding clip according to the invention is so constructed that a pair of engaging projections are formed at portions continuing from the opening to the receiving portion for receiving the object to be bound, the engaging projections being adapted to overlap each other and project into the receiving portion for receiving the object to be bound when the leg portions are crossed. Therefore, when the bag, net or the like is bound, a force of the object coming out toward the crossed parts of the leg portions will be divided in the two directions by means of the engaging projections, thus preventing the object to be bound from coming out toward the crossed parts of the leg portions.

Further, because the force of the plastic bag, net or the like which tends to expand will be held by the receiving portion and the engaging projections, the engaging projections are pressed against the plastic bag, net or the like which tends to expand, and the distal ends of the engaging projections hold the plastic bag, net or the like in a biting attitude, whereby the strong binding force can be obtained.

Still further, because the receiving portion for receiving the object to be bound is in a substantially triangular shape making the deepest end of the opening as the apex, the tapered portions consisting of the two edges with the deepest end as the apex act to press the plastic bag, net or the like toward the engaging projections, whereby the strong binding force can be obtained.

While only certain embodiments of the invention have been specifically described herein, it will be apparent that numerous modifications may be made thereto without departing from the spirit and scope of the invention.

The present invention is based on Japanese Patent Application No. Hei. 11-199563 which is incorporated herein by reference.

What is claimed is:

1. A binding clip formed from a flat plate material, said binding clip comprising:

an opening at one end;

a receiving portion for receiving an object to be bound in the depths of said opening;

a pair of leg portions defining said opening and adapted to be crossed with each other thereby to bind the object to be bound; and a pair of engaging projections bulgingly formed at portions continuing from said opening to said receiving portion, wherein said engaging projections are adapted to overlap each other and project into said receiving portion when said leg portions are crossed, wherein said receiving portion is in a substantially triangular shape making a deepest end of said opening as an apex when said leg portions are not crossed.

2. A binding clip formed from a flat plate material, the binding clip comprising:

an opening at one end;

a receiving portion for receiving an object to be bound in a depth of the opening;

a pair of leg portions defining the opening and adapted to be crossed with each other to bind the object; and a pair of engaging projections bulgingly formed at portions continuing from the opening to the receiving portion, wherein the receiving portion is formed by walls that define a polygon when the leg portions are not crossed and includes one wall of the polygon extending into the receiving portion when the leg portions are crossed, wherein the polygon is a triangle.

3. A binding clip formed from a flat plate material, the binding clip comprising:

an opening at one end;

a receiving portion for receiving an object to be bound in a depth of the opening;

a pair of leg portions defining the opening and adapted to be crossed with each other to bind the object; and a pair of engaging projections bulgingly formed at portions continuing from the opening to the receiving portion, wherein the receiving portion is formed by walls, each wall defining an imaginary line that extends outside of the receiving portion when the leg portions are not crossed, and wherein at least one imaginary line extends into the receiving portion when the leg portions are crossed, wherein the receiving portion is shaped like a triangle.

4. A binding clip formed from a flat plate material, the binding clip comprising:

an opening at one end;

a receiving portion for receiving an object to be bound in a depth of the opening;

a pair of leg portions defining the opening and adapted to be crossed with each other to bind the object; and a pair of engaging projections bulging at portions continuing from the opening to the receiving portion, wherein said receiving portion defines a planar set of convex points when the leg portions are not crossed.

5. The binding clip according to claim 4, wherein said engaging projections bite the bound object when said leg portions are crossed.

6. The binding clip according to claim 4, wherein said receiving portion is further defined by receiving edges extending at an angle of substantially 90 degrees from an apex in a deepest end of said receiving portion.

7. The binding clip according to claim 4, wherein said opening includes opening edges tapered toward said receiving portion.

8. The binding clip according to claim 4, wherein said leg portions include engaging portions and are hooked with each other when said leg portions are crossed.

9. The binding clip according to claim 4, wherein said leg portions are held crossed by at least one of bonding, caulking, and stapling when said leg portions are crossed.

10. The binding clip according to claim 4, wherein a plurality of binding clips are connected at distal portions of said binding clip.

11. The binding clip according to claim 4, wherein said engaging projections bulge toward one another when said leg portions are uncrossed;

wherein said engaging projections are adapted to overlap each other and project into said receiving portion when said leg portions are crossed; and wherein said engaging projections divide in two directions an expanding force of the bound object tending to uncross the leg portions when said engaging projections are overlapped so as not to expand the binding clip.

12. A binding clip formed from a flat plate material, the binding clip comprising:

an opening at one end;

a receiving portion for receiving an object to be bound in a depth of the opening;

a pair of leg portions defining the opening and adapted to be crossed with each other to bind the object; and a pair of engaging projections bulging at portions continuing from the opening to the receiving portion, wherein the receiving portion is formed by walls, each wall lying along a respective coplanar infinite-length imaginary line that does not extend inside the receiving portion when the leg portions are not crossed.

* * * * *